US005331925A

United States Patent [19]

Tsepenyuk

[11] Patent Number: 5,331,925

[45] Date of Patent: Jul. 26, 1994

[54] INTERNAL COMBUSTION ENGINE

[76] Inventor: Mikhail Tsepenyuk, 22 Fort Hamilton Pkwy., Brooklyn, N.Y. 11218

[21] Appl. No.: 370

[22] Filed: Jan. 4, 1993

[51] Int. Cl.[5] ..... F02B 75/28

[52] U.S. Cl. ..... 123/56 AC; 123/56 BC; 123/52 A

[58] Field of Search ..... 123/56 AC, 56 BC, 52 A, 123/71 R, 52 R

[56] References Cited

U.S. PATENT DOCUMENTS

| | | | |
|---|---|---|---|
| 1,547,173 | 7/1925 | Knight | 123/52 A |
| 2,247,299 | 6/1941 | Klavik | 123/56 BC |
| 2,293,352 | 8/1942 | Molina | 123/56 AC |
| 3,195,420 | 7/1965 | Johannsen | 123/56 AC |
| 3,731,662 | 5/1973 | Fandrich | 123/71 R |
| 4,419,969 | 12/1983 | Bundrick | 123/52 A |
| 4,485,768 | 12/1984 | Heniges | 123/56 AC |
| 4,776,304 | 10/1988 | Korosue | 123/56 AC |

*Primary Examiner*—Tony M. Argenbright
*Assistant Examiner*—M. Macy
*Attorney, Agent, or Firm*—Ilya Zborowsky

[57] ABSTRACT

An internal combustion engine has a plurality of cylinders and two pistons located in each of the cylinders and forming two combustion chambers with the latter.

9 Claims, 3 Drawing Sheets

INTERNAL COMBUSTION ENGINE

BACKGROUND OF THE INVENTION

The present invention relates to internal combustion engines, and in particular to piston-type internal combustion engines.

Internal combustion engines are generally known. One of the known internal combustion engines is an internal combustion engine H1G2OV5HAG3 produced by General Motors and including four cylinders arranged in a row with pistons each arranged in a respective one of said cylinders and connected by piston rods with an output shaft. The internal combustion engine is widely used and is reliable in operation. However, it has the disadvantage in that it is characterized by relatively low power per weight unit, relatively low efficiency and undesirable forces in the unit cylinder-piston due to the piston rods and as a result the one-sided wear of the surfaces of the engine cylinders.

Also, an engine with V-shaped arrangement is known, such for example 911CS-2.71 produced by Porsche. This engine has 3–4 pairs of cylinders arranged in a row, and the cylinders of each pair are arranged at an angle V relative to one another with each cylinder having a piston connected with an output shaft by piston rods. The engine has higher power per weight unit, however still its efficiency is relatively low and also undesirable forces in the unit cylinder-piston are produced with the resulting one-sided wear of the surfaces of the engine cylinders.

SUMMARY OF THE INVENTION

Accordingly, it is an object of the present invention to provide an internal combustion engine with a higher efficiency and power per weight unit.

In keeping with these objects and with others which will become apparent hereinafter, one feature of the present invention resides, briefly stated, in an internal combustion engine having a plurality of cylinders, in which each cylinder has two pistons connected with output shaft means, while the pistons can be both movable relative to one another, alternatively one piston can be movable and the other piston cannot be movable and further alternatively there can be two movable pistons and an immovable piston therebetween.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
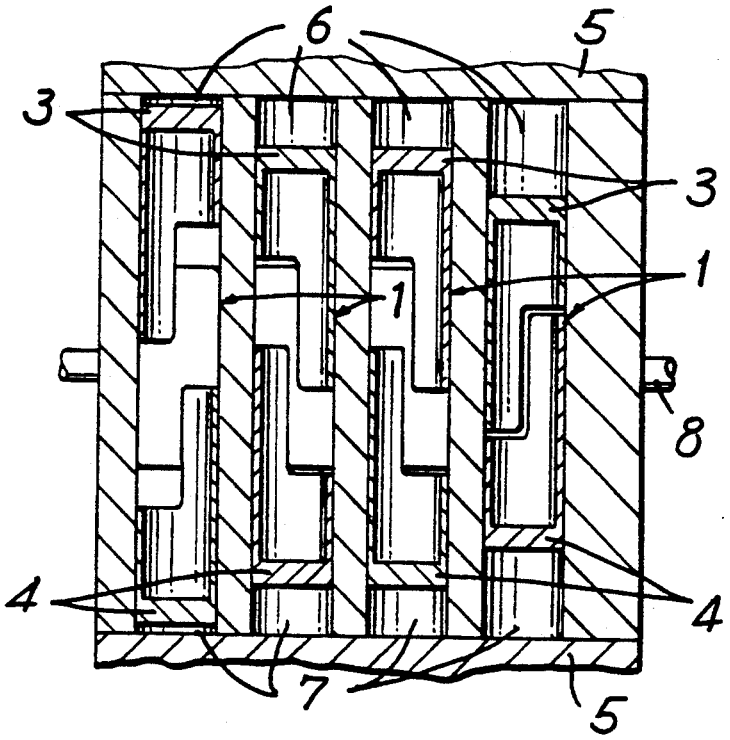
FIG. 1 is a view showing a section of an internal combustion engine.
Figure 2:
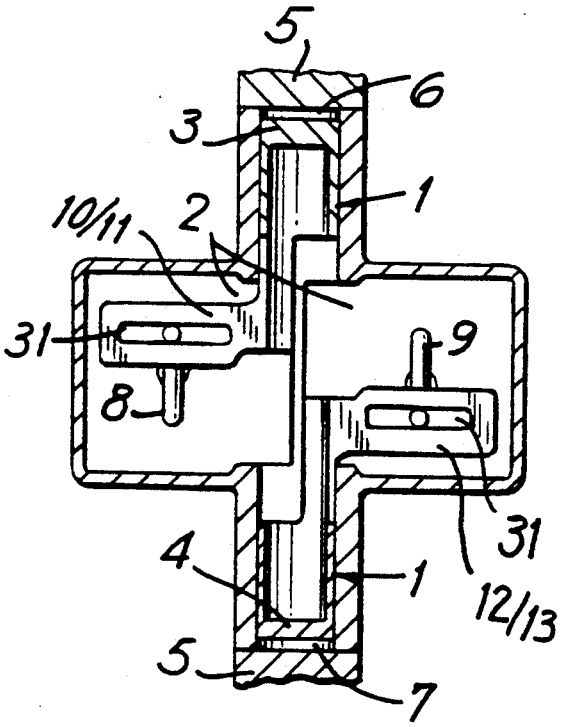
FIGS. 2 and 3 are views showing a section of the cylinder of the internal combustion engine in upper and lower dead points of the working cycle.
Figure 3:
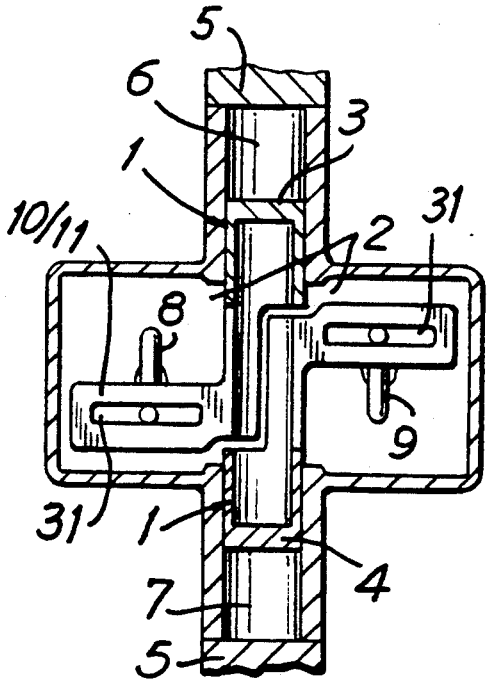
Figure 4:
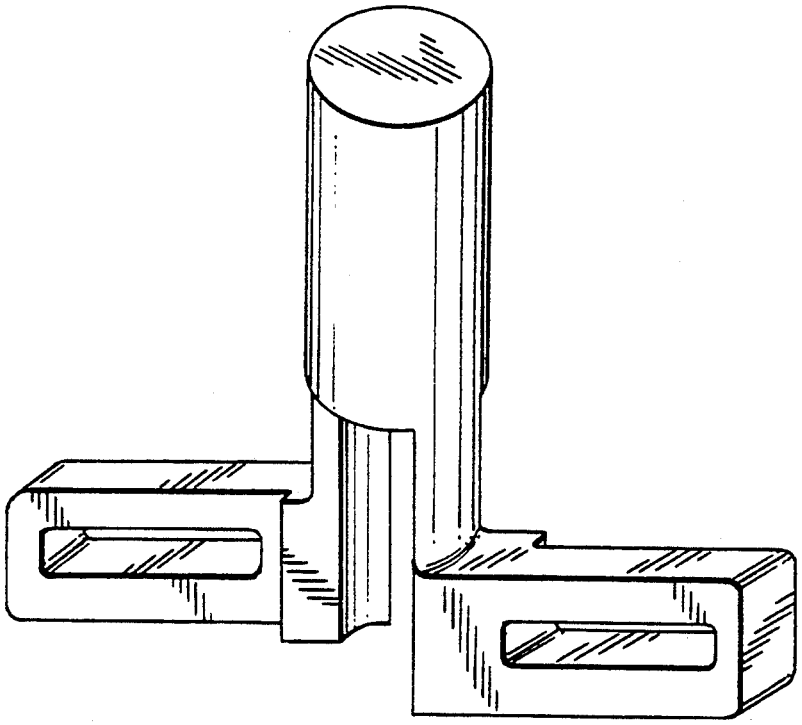
FIG. 4 is a view showing a working movable piston in perspective.
Figure 8:
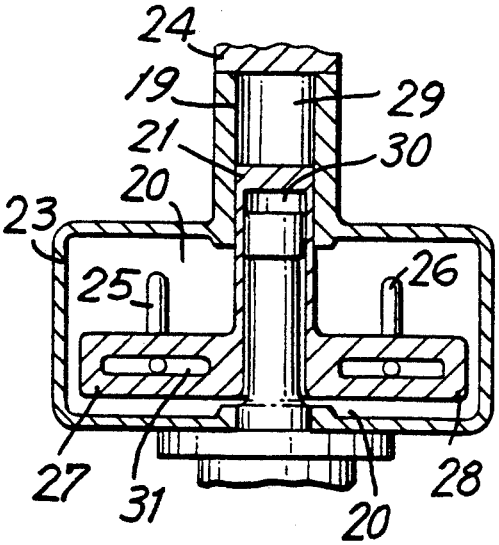

The internal combustion engine shown in FIGS. 1, 2 and 3 has a cylinder 1 with a window 2, two movable pistons 3 and 4 shown in FIG. 4, two cylinder heads 5 which form with the pistons 3 and 4 shown in FIG. 4, two cylinder heads 5 which form with the pistons 3 and 4 two combustion chambers 6 and 7, and two output shafts 8 and 9. The output shafts 8 and 9 are connected with the movable pistons 3 and 4 by coulisses 10, 11, 12 and 13. The coulisses are fixedly connected with the pistons 3 and 4 so that two coulisses are connected with each piston. The output shafts 8 and 9 are formed as crank shafts as shown in FIG. 8. The cylinders 1 are fixedly connected with casings 14 located at both sides of the cylinder 1. The casing 14 accommodates the output shafts 8 and 9 and also other systems which are well known in the art and used for operation of the internal combustion engine. These systems are arranged both in the cylinder heads 5 and in the casing and are not shown in the drawings. The casing 14 carries coupling bearings of the output shaft 15.

The internal combustion engine in accordance with another embodiment of the invention has, in addition, an immovable piston 16 which is fixedly connected with the casing 14. The piston 16 forms with the movable pistons 3 and 4 additional chambers 17 and 18. There can be two modifications of the internal combustion engine shown in FIGS. 5 and 6. In accordance with one modification, the internal combustion engine can be provided with a system of supply and withdrawal of a compressed working medium to and from the chambers 17 and 18. In accordance with another modification, the internal combustion engine can be supplied with the system which provides the operation of the chambers 17 and 18 as combustion chambers.

Figure 7:
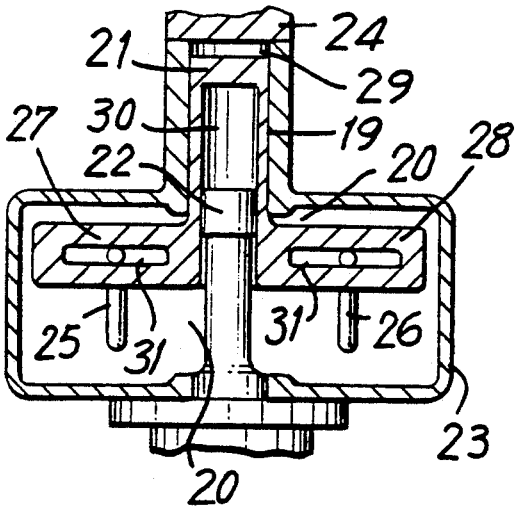
FIGS. 7 and 8 are views showing a section of the cylinder in accordance with still a further embodiment of the present invention in upper and lower dead points.

In accordance with a further embodiment of the present invention shown in FIG. 7, the internal combustion engine has a cylinder 19 with a window 20. A movable piston 21 and an immovable piston 22 are located in the cylinder. The immovable piston 22 is fixedly connected with the casing 23. The engine has cylinder covers 24, two output shafts 25 and 26 connected with coulisses 27 and 28. The movable piston 21 and the cylinder cover 24 form a combustion chamber 29, while the immovable piston 22 forms chamber 30. The internal combustion engine is also provided with systems necessary for operation of the engine, which are not shown in the drawings.

Figure 10:
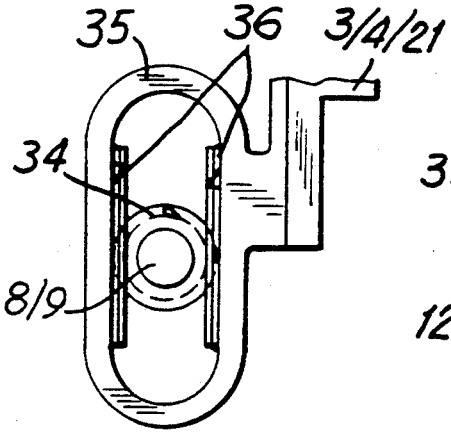
FIG. 10 is a view showing an output shaft and a ratchet type connection with the pistons.

The coulisses 10, 11, 12, 13, 27 and 28 are formed as rectangular projections in FIG. 8 with openings 31. Their lengths are not less than the stroke of the movable piston and their widths are not less than the diameter of a neck 32 of the output shafts 8 and 9. The neck 32 is arranged on the output shaft so as to be turnable relative to one another, on sliding bearings 33 shown in FIG. 9. It is also possible to use a ratchet connection, represented by a coupling 34 shown in FIG. 10. The coupling 34 is mounted on the output shaft, while the movable pistons 3, 4 and 21, instead of the coulisses 10, 11, 12, 13, 27, 28 are provided with toothed racks 35. The toothed rack is formed as an ellipse with teeth 36 on its rectilinear portions.

The combustion engine shown in FIGS. 1, 2 and 3 operates in the following manner. By means of a starter which is not shown in the drawings, the output shafts 8 and 9 are turned, and through the coulisses 10, 11, 12 and 13 impart a reciprocating movement to the pistons 3 and 4. During the movement of the pistons 3 and 4 from the upper dead point in FIG. 2 to the lower dead point in FIG. 3 the suction or injection of the fuel mixture into one of the combustion chambers, for example chamber 6, is performed with movement of the pistons in an opposite direction, the compression of the combustion mixture is performed and in the upper dead point shown in FIG. 2 it is ignited. The gas mixture created as a result of the combustion of the mixture pushes the piston 4 and urges it to move to the lower dead point, during which movement suction or injection of the combustion mixture into the chamber 7 occurs. When the movable piston 4 moves through the lower dead point, the connection of the chamber 6 with the exterior is performed and the exhaust of the exhaust gases occurs. Simultaneously, the compression in the compression chamber 7 takes place, since the movable pistons 3 and 4 simultaneously move to the upper dead point. As a result, the movable pistons 3 and 4 pass all phases of the working cycle, but with the offset of 360° . If the cylinder has a plurality of cylinders then the remaining pairs of pistons have an offset of phases 360° /n, wherein n is the number of cylinders.

The reciprocating movement of the pistons 3 and 4 through the coulisses 10, 11, 12 and 13 act simultaneously on two output shafts 8 and 9, and more particularly onto the neck 33 with the forces which are perpendicular to the horizontal plane of symmetry of the engine, and urge it to roll on the surface of the opening 32. The forces which act on two output shafts 8 and 9 are equal in any moment of time and are located symmetrically relative to the longitudinal axis of the working pistons.

Figure 5:
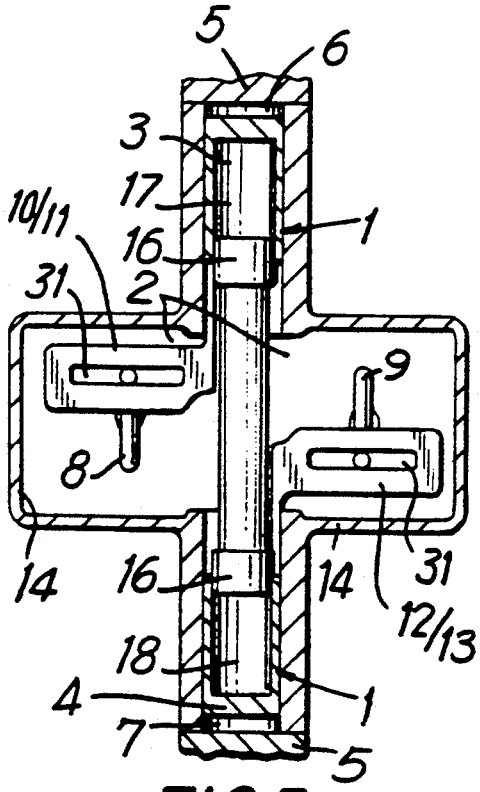
FIGS. 5 and 6 are views showing a section of the cylinder in accordance with another embodiment of the present invention in upper and lower dead points.
Figure 6:
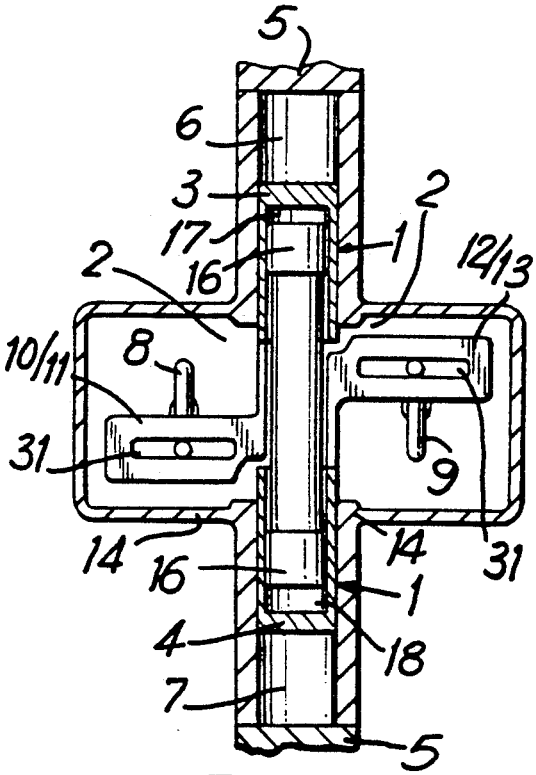

The internal combustion engine in accordance with the second embodiment shown in FIGS. 5 and 6 operates with respect to the movable pistons 3 and 4 the same as in the first embodiment. The presence of the immovable piston 16 and the chambers 17 and 18 provides for a possibility of supplying into these chambers of a compressed working medium during the movement of the movable pistons from the lower dead point to the upper dead point and vacuuming of the chambers 17 and 18 during the opposite movement of the movable pistons 3 and 4. As a result, the power of the engine can be increased up to 5%. In order to produce the compressed working medium and vacuum, it is possible to use the turbocharger which is known in the art.

The internal combustion engine having the immovable piston between the movable pistons and two chambers 17 and 18 can operate so that the chambers 17 and 18 are combustion chambers. In other words, a combustion mixture is sucked or supplied to the chambers 17 and 18 when the movable pistons 3 and 4 move from the lower dead point to the upper dead point, and then the compression is performed during the opposite movement of the movable pistons. When they are located at the lower dead point the ignition of the combustion mixture is performed. The pressure produced in the chambers 17 and 18 acts on the internal surface of the pistons 3 and 4 and transmits energy to them.

The internal combustion engine in accordance with another embodiment having one movable piston and one immovable piston operates in the same way as the previous internal combustion engines, since it is kind of a half of the internal combustion engine described hereinabove.

Figure 9:
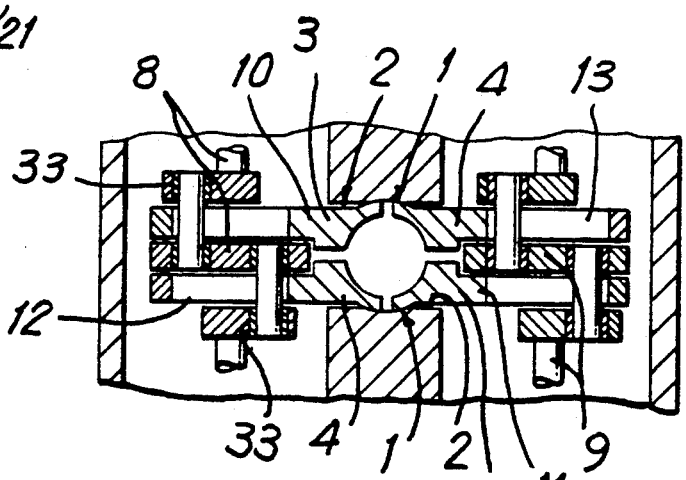
FIG. 9 is a view showing an output shaft and a coulisse-type connection with the pistons.

In the internal combustion engine described hereinabove, instead of coulisses, ratchet couplings shown in FIG. 9 can be used. In this situation the movable pistons are provided with the toothed racks 35 which transfer to the ratchet coupling 34 a rotation through the teeth 36, During the movement in opposite direction different parts of the teeth 36 operate.

It should be mentioned that in the embodiments of FIGS. 2, 3 and 5, 6 the centers of gravity of the movable pistons are spaced at equal distances from a plane extending through the axes of rotation of the output shafts.

When the internal combustion engine is designed in accordance with the present invention and the coulisse is used, the torque can be increased approximately by 7% as compared with known internal combustion engines, the undesired one-sided force in the unit piston-cylinder and therefore the one-sided wear is avoided, the provision of two movable pistons in each cylinder makes the engine compensated in the sense of the forces since in any point of time the movable pistons are equally spaced from the horizontal axis of symmetry. Two output shafts make possible to use the internal combustion engine in cars which have a drive for each wheel and automatic transmission elements providing the necessary rotary speed for each wheel in any point of time. The wheel has an increased power which can be used over short periods as well as over long periods of time, because of the presence of auxiliary combustion chambers both in a two-cycle and a four-cycle operational mode. This is especially important for tractor vehicles during climbing up and also for race cars which need sharp speed increase on a straight roadway. The power can be increased by 1.4–1.8 in four-cycle engines and by 2.8–3.6 in two-cycle engines with the auxiliary combustion chambers. Sufficient power can be obtained with a minimal size, which is very important for light vehicles such as motorcycles, etc. Also the engine can be used for aviation in which case it can be light weight and have a high power.

It will be understood that each of the elements described above, or two or more together, may also find a useful application in other types of constructions differing from the types described above.

While the invention has been illustrated and described as embodied in an internal combustion engine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. An internal combustion engine, comprising a plurality of cylinders; two pistons located in each of said cylinders and forming two combustion chambers with the latter; and two output shafts, each of said cylinders having two windows through which said two pistons of each of said cylinders are connected with said two output shafts, each of said pistons being connected to both output shafts.

2. An internal combustion engine, comprising a plurality of cylinders; two output shafts; and two pistons located in each of said cylinders and forming two combustion chambers with the latter, said two pistons of each of said cylinders being movable relative to one another in a direction perpendicular to a plane extending through axes of rotation of said two output shafts.

3. An internal combustion engine as defined in claim 2, wherein said two pistons of each of said cylinders are movable relative to one another.

4. An internal combustion engine as defined in claim 2; and further comprising output shaft means connected with said pistons; and connecting means for connecting said pistons with said output shaft means, said connecting means including a coulisse.

5. An internal combustion engine as defined in claim 2; and further comprising output shaft means connected with said pistons; and connecting means for connecting said pistons with said output shaft means, said connecting means including a ratchet.

6. An internal combustion engine, comprising a plurality of cylinders; two pistons located in each of said cylinders and forming two combustion chambers with the latter; and a third immovable piston located between said first two pistons and forming with the latter two additional combustion chambers.

7. An internal combustion engine as defined in claim 6; and further comprising means for operating said additional combustion chambers.

8. An internal combustion engine, comprising a plurality of cylinders; and two pistons located in each of said cylinders and forming two combustion chambers with the latter, one of said pistons in each of said cylinders being movable, while another of said pistons in the same cylinder is immovable.

9. An internal combustion engine, comprising a plurality of cylinders; two pistons located in each of said cylinders and forming two combustion chambers with the latter; and two output shafts turnable by said pistons and having axes of rotation, said pistons having centers of gravity which are located at opposite sides of a plane extending through said axes of rotation and spaced at equal distance from said plane.

* * * * *